United States Patent [19]

Lee

[11] Patent Number: 4,639,308

[45] Date of Patent: Jan. 27, 1987

[54] CATALYTIC CRACKING PROCESS

[75] Inventor: Fu-Ming Lee, Bartlesville, Okla.

[73] Assignee: Phillips Petroleum Company, Bartlesville, Okla.

[21] Appl. No.: 819,316

[22] Filed: Jan. 16, 1986

[51] Int. Cl.[4] ..... C10G 11/18

[52] U.S. Cl. ..... 208/100; 208/103; 208/113; 208/310 R

[58] Field of Search ..... 208/113, 120, 99, 100, 208/103, 310 R; 502/38, 41, 55

[56] References Cited

U.S. PATENT DOCUMENTS

| | | | |
|---|---|---|---|
| 2,355,366 | 8/1944 | Conn | 208/89 |
| 3,412,013 | 11/1968 | Bowles | 208/120 |
| 3,617,504 | 11/1971 | Berg | 208/100 |
| 4,146,465 | 3/1979 | Blazek, Sr. et al. | 208/120 |
| 4,345,992 | 8/1982 | Wasber et al. | 208/120 |
| 4,361,496 | 11/1982 | Castillo et al. | 208/113 |
| 4,377,470 | 3/1983 | Hettinger et al. | 208/120 |
| 4,422,925 | 12/1983 | Williams et al. | 208/75 |
| 4,424,116 | 1/1984 | Hettinger | 208/120 |
| 4,431,515 | 2/1984 | Myers et al. | 208/108 |
| 4,447,315 | 5/1984 | Lamb et al. | 208/99 |
| 4,479,870 | 10/1984 | Hammershaimb et al. | 208/113 |
| 4,504,379 | 3/1985 | Stuntz et al. | 208/113 |

OTHER PUBLICATIONS

"Petroleum Refining", by James Gary and Glenn Handwerk, Marcel Dekker, Inc., 1975, pp. 86–95.

"Mono-olefins Chemistry and Technology", by F. Asinger, Pergamon Press, 1968, pp. 256–259, 283, 295.

*Primary Examiner*—Brian E. Hearn

*Assistant Examiner*—O. Chaudhuri

*Attorney, Agent, or Firm*—K. K. Brandes

[57] ABSTRACT

A process for catalytically cracking a hydrocarbon-containing feed stream, preferably having an API[60] gravity of about 5–30, wherein at least a portion of off-gases is treated so as to remove $C_2$–$C_4$ olefins therefrom, and the off-gas stream having a reduced olefin content is then recycled to the catalytic cracking zone.

20 Claims, 1 Drawing Figure

CATALYTIC CRACKING PROCESS

BACKGROUND OF THE INVENTION

Catalytic processes for cracking liquid hydrocarbon streams, in particular heavy petroleum fractions, are well known. It is also known to recycle at least a portion of the produced gases (called off-gases) to the cracking reactor, generally in admixture with regenerated cracking catalyst. However, there is an ever present need to develop improved cracking processes resulting in enhanced yields of desired products (in particular gasoline) and in reduced formation of undesirable products (in particular coke).

SUMMARY OF THE INVENTION

It is an object of this invention to provide an improved catalytic cracking process. It is another object of this invention to provide an improved process for catalytically cracking heavy hydrocarbon feed streams resulting in enhanced gasoline yield and reduced coke formation. It is a further object of this invention to provide a catalytic cracking process wherein at least a portion of the product gases (off-gases) is treated and then recycled to the cracking reactor. Other objects and advantages will be apparent from the detailed description, the drawing and the appended claims.

In accordance with this invention, there is provided a catalytic cracking process comprising the steps of:

(A) contacting (a) an oil feed stream comprising hydrocarbons having more than ten carbon atoms per molecule (preferably having from 10 to 50 carbon atoms per molecule) with (b) a solid cracking catalyst, under such conditions as to obtain (c) gaseous products comprising hydrogen, paraffins having from 1–4 carbon atoms per molecule and olefins having from 2–4 carbon atoms per molecule and (d) at least one (i.e., one or more) stream of substantially liquid products (i.e. being substantially liquid at about 30° C. and one atm) comprising hydrocarbons having an average molecular weight lower than that of the hydrocarbons in the feed stream;

(B) substantially separating said gaseous products from said at least one stream of substantially liquid products and said solid cracking catalyst;

(C) treating at least a portion of the stream of said separated gaseous products (from step B) under such conditions as to reduce therein the content of olefins having 2–4 carbon atoms per molecule;

(D) recycling at least a portion of said gaseous products having reduced olefin content to the contacting (cracking) zone of step A (where the feed stream is contacted with the cracking catalyst), and (E) repeating steps A through D.

Preferably, substantially all $C_2$–$C_4$ olefins are removed from the separated gaseous products in step C; and preferably, the gaseous products recycled in step D are substantially olefin-free, i.e., they contain less than about 0.05 volume-% of olefins.

In one embodiment of this invention, the catalytic process is a fluidized catalytic cracking (FCC) process wherein at least a portion of used FCC catalyst (separated from gaseous and liquids products) is regenerated by methods well known in the art (such as stream stripping and subsequent heating in a free oxygen containing gas, preferably air). In a preferred embodiment of this invention, at least a portion of said gaseous product stream having reduced olefin content (from step C) is first combined with at least a portion of said regenerated FCC catalyst (generally still hot) and is then recycled, in admixture with the regenerated FCC catalyst, to the cracking zone in accordance with step D. Generally the regenerated FCC catalyst is in a fluidized (i.e., suspended) state in this combined (admixed) gas/catalyst stream.

The removal of olefins in step C can be carried out by any method known in the art. Preferably olefins are removed from the gaseous product stream by absorption employing a suitable copper(I) compound, generally dissolved in a suitable solvent. The absorbed olefins can, if desired, be recovered by thermally decomposing the copper(I)-olefin complex formed in this absorption process.

The process of this invention results in higher yield of liquid products boiling in the gasoline range (about 90°–220° F. at atmospheric pressure) and being useful as motor fuel, and in less coke formation than similar cracking processes that either operate without any recyle of gaseous products to the cracking reactor or recycle untreated off-gases, which contain considerable amounts of olefins.

DETAILED DESCRIPTION OF THE INVENTION

Figure 1:
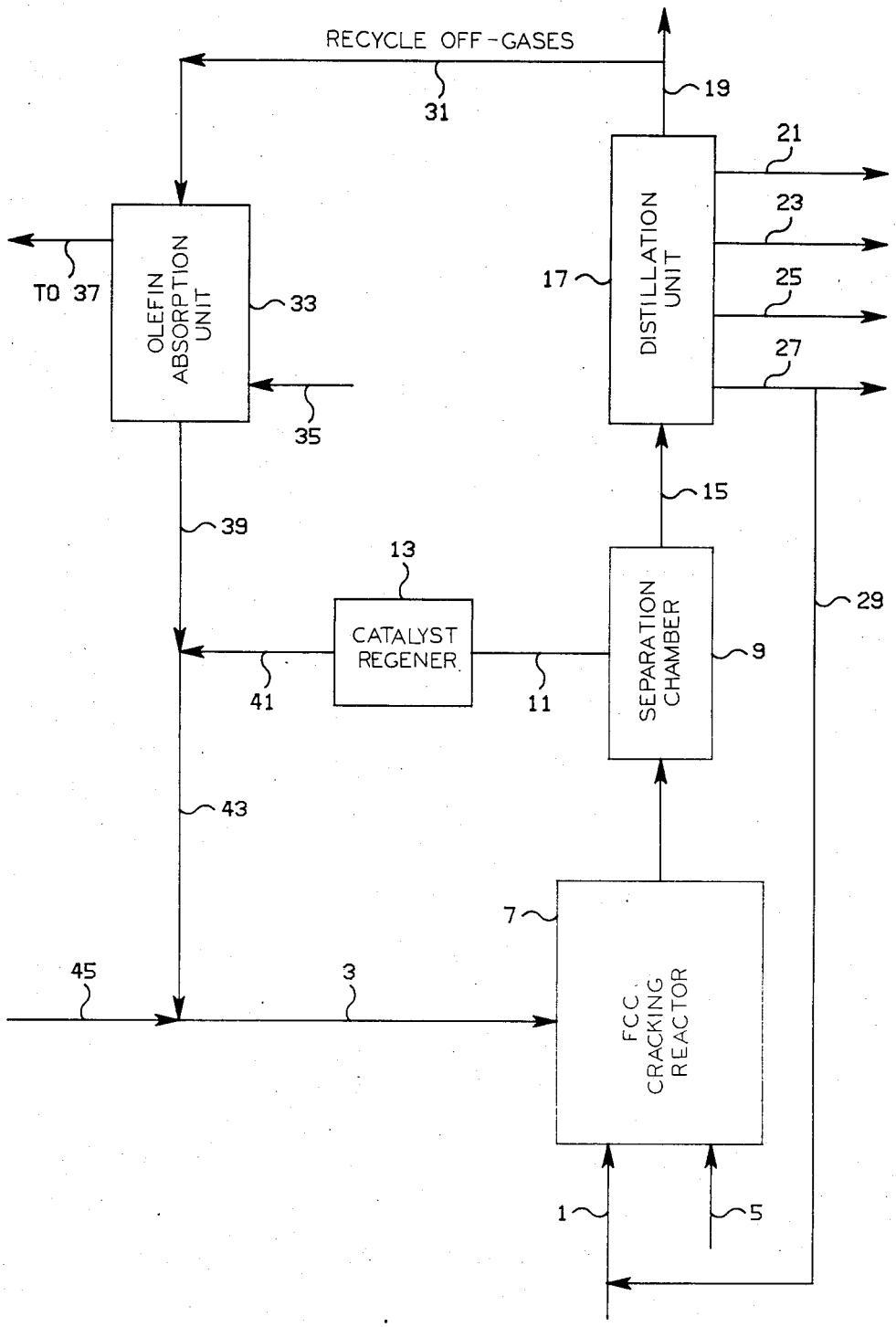
FIG. 1 is a schematic representation of a preferred embodiment of the process of this invention.

The hydrocarbon oil feed employed in this invention can be any hydrocarbon or, preferably, any mixture of hydrocarbons with more than ten carbon atoms per molecule that can be cracked to lighter products. Typical feeds include heavy crude petroleum, heavy and vacuum gas oils, fuel oils, cycle oils, slurry oils, topped crudes, heavy residual oils, hydrotreated topped crudes and residual oils, shale oils or heavy fractions thereof, coal pyrolyzates, products from extraction/liquefaction of coal, products from tar sands, and the like, as well as mixture thereof. These feeds are generally liquid but may be so viscous at 25° C./1 atm that they don't flow. However, all these feeds are substantially liquid after being heated to the temperature of the cracking reactor.

Generally the $API^{60}$ gravity of the hydrocarbon feed is in the range of from about 5 to about 30. Many of these feeds contain sulfur (generally about 0.1–4 weight-%) and metals, generally 0.1–30 ppm Ni and 0.1–50 ppmw V (ppmw=parts of metal per million parts of feed by weight). Presently preferred feeds are heavy gas oils ($API^{60}$ gravity: 15–30; boiling range at atmospheric pressure: 600°–1000° F.), and residual petroleum oils that have been catalytically hydrotreated (so as to remove a substantial portion of metals and sulfur compounds therefrom) having $API^{60}$ gravity of about 10–30 and boiling under atmospheric pressure conditions at above about 600° F.

The solid cracking catalyst employed in this invention can be any catalyst composition that is effective in cracking liquid hydrocarbons, such as catalysts comprising amorphous silica-aluminas and/or crystalline aluminosilicates (zeolites and/or clays, preferably at least one zeolite). Generally the surface area (BET/$N_2$ method) of these cracking catalysts is in the range of from about 50 to about 200 $m^2/g$, and the pore volume generally ranges from about 0.2 to about 1.0 cc/g. Nonlimiting examples of zeolite-type cracking catalysts are listed in U.S. Pat. Nos. 4,377,470 and 4,424,116, herein incorporated by reference. Since generally cracking catalysts are regenerated (preferably by steam stripping for removal of adhered oil and subsequent oxidation so as to burn off carbon deposits) and then recycled (with or without added fresh catalysts) to the cracking reactor, these recycled catalysts (called equilibrium catalysts) generally contain small amounts of metals (Ni, V) deposited from heavy oil feeds. Two specific, presently preferred zeolite-containing equilibrium cracking catalysts are described in Example I.

Any suitable reactor can be used for the catalytic cracking step A of this invention. Generally a fluidized-bed catalytic cracking (FCC) reactor (preferably containing one or more risers) or a moving-bed catalytic cracking reactor (e.g., a Thermofor catalytic cracker) is employed, preferably a FCC riser cracking unit. Examples of such FCC cracking units are described in earlier cited U.S. Pat. Nos. 4,377,470 and 4,424,116. Generally a catalyst regeneration unit is combined with the FCC cracking unit as is shown in the above-cited patents.

Specific operating conditions of the cracking operation of step A depend greatly on the type of feed, the type of employed catalyst, and type and dimensions of the cracking reactor and the oil feed rate. Examples of operating conditions are described in the above-cited patents and in many other patents and publications. In an FCC operation, generally the catalyst to oil feed(hydrocarbon-containing feed) weight ratio ranges from about 2:1 to about 10:1, and the contact time between oil feed and catalyst is in the range of about 0.2 to about 2.0 seconds. Generally steam is added with the oil feed to the FCC reactor so as to aid in the dispension of the oil as droplets. Generally the weight ratio of steam to oil feed is in the range of from about 0.01:1 to about 0.1:1.

The separation of spent (i.e., used) cracking catalyst from gaseous and liquid cracked products (step B) and the separation into various gaseous and liquid product fractions can be carried out by any conventional separation means. Non-limiting examples of such separation schemes are shown in "Petroleum Refining" by James H. Gary and Glenn E. Handwerk, Marcel Dekker, Inc., 1975.

Any method for removing $C_2$–$C_4$ olefins from at least a portion of the separated, gaseous cracked products (off-gases) can be employed. Examples of such olefin removal include catalytic hydrogenation (to form alkanes), e.g., in the presence of catalysts that contain metals of Group VIII of the Periodic Table such as Ni, Pt and Pd. Furthermore, olefins can be separated from the off-gas steam by cryogenic distillation (i.e., fractional distillation at temperatures below 0° C.). Preferably, $C_2$–$C_4$ olefins are removed by passing the off-gas stream through an absorption unit containing an olefin complexing agent as absorbent. Non-limiting examples of such complexing agents are copper(I) chloride, cooper(I) nitrate, copper(I) formate, copper(I) acetate, copper(I) phenolate, copper(I) cresolate, copper(I) salicylate and the like, generally dissolved in a suitable solvent such as aqueous ammonia and/or ethanolamine. Also certain silver compounds such as $AgNO_3$, generally applied as an aqueous solution, and 65% aqueous sulfuric acid can be used to absorb $C_2$–$C_4$ olefins. Presently preferred are Cu(I) compounds (listed above).

The absorption of olefins, as described above, is generally carried out by countercurrent absorption at a temperature of about 0°–25° C. and a pressure of about 2–15 atm. The thus absorbed olefins are generally recovered by desorption at a higher temperature (e.g., 30°–50° C.) and a lower pressure (2–2 atm), i.e., by heating and decompressing the absorbing solution which contains absorbed olefins. Non-limiting examples of olefin removal processes by absorption and pertinent operating conditions are described in "Monoolefins Chemistry and Technology" by F. Asinger, Pergamon Press, 1968.

The preferably substantial olefin-free off-gas stream obtained by the treatment of step C is then recycled to the cracking reactor. This treated off-gas (comprising $C_1$–$C_4$ paraffins and also hydrogen) can be introduced into the cracking reactor at any suitable point. It can be combined with the oil feed; or it can be mixed and injected with steam (if used); or it can be injected directly into the fluidized catalyst bed. Preferably, however, the treated off-gas having reduced olefin content is used as a fluidizing gas for steam-stripped and oxidized (regenerated) FCC cracking catalyst (and, optionally, fresh FCC catalyst) and is transported in combination with the FCC catalyst through a conduit into the cracking zone, e.g., a riser of a FCC cracking unit.

Generally the weight ratio of recycled off-gas having substantially reduced olefin content to hydrocarbon (oil) feed is in the range of from about 0.05:1 to about 1:1, preferably from about 0.3:1 to about 0.7:1. The weight ratio of this recycled off-gas to cracking catalyst is in the range of from about 0.01:1 to about 0.5:1, preferably from about 0.05:1 to about 0.2:1.

A preferred embodiment of this invention will now be described in conjunction with the drawing in FIG. 1, which is a schematic representation of the preferred process of this invention. Oil feed stream 1, cracking catalyst containing stream 3 and, optionally, steam stream 5 are introduced into FCC cracking reactor 7. Cracked products and spent catalyst admixed therewith flow into cyclone separation chamber 9 where spent catalyst is substantially separated from gaseous and liquid products. The spent catalyst is transferred through line 11 into catalyst regenerator 13, while gaseous/liquid products are transferred through line 15 into fractional distillation unit 17 where the products are separated into an off-gas stream 19, a gasoline stream 21, a light cycle oil stream 23, a heavy cycle gas oil stream 25, and a bottom stream 27, a portion of which is recycled as slurry oil stream 29 to the cracking reactor 7 (in combination with fresh oil feed).

At least a portion of gaseous product stream (off-gas stream) 19 is introduced through line 31 into olefin absorption unit 33, where most olefins are removed from the recycle off-gas (31) by countercurrent absorption, under elevated pressure, with a solution containing a suitable complexing agent (preferably a Cu(I) salt), introduced through line 35. Olefins can be recovered from the absorbent solution by heating and pressure reduction, generally in a different unit (37, not shown). The gaseous products having reduced olefin content (preferably being substantially olefin-free) exit through conduit 39 and are combined with hot regenerated catalyst stream 41. To the combined stream 43 of regenerated catalyst and treated off-gas is added a stream of fresh cracking catalyst 45 so as to obtain stream 3 (containing cracking catalyst and substantially olefin-free off-gas) which is charged to the cracking zone.

The following examples are presented to further illustrate the invention and are not to be considered unduly limiting the scope of this invention.

EXAMPLE I

This example illustrates the experimental bench-scale setup for invention and control cracking tests. A heavy oil feed was continuously pumped by means of a syringe pump through a horizontal heated stainless steel tube into a vertical induction tube (about 1/16 inches inner diameter) and then pumped downward by means of a piston pump into a heated fluidized catalyst bed (inner diameter: about 1¼ inches; height: about 4 inches). This catalyst bed was filled with about 35 grams of a commercial "equilibrium" cracking catalyst (i.e., a catalyst that had been used in a cracking process and had been regenerated by steam stripping and high temperature oxidation with air). This catalyst was fluidized by passing an upflow stream of nitrogen gas (about 160 cc/minute) through the reactor. When a recycle gas was used, the nitrogen flow was stopped and the specific recycle gas was passed through the gas inlet located at the bottom of the reactor at about 160 cc/minute. The reactor was heated by means of a furnace equipped with temperature control. The reactor temperature was measured by means of a thermocouple located in the mid-section of the reactor.

The cracked products exited the reactor through an outlet tube located in the upper side wall of the reactor. The product stream was first passed through a cold trap (temperature: about 0° C.), where essentially all condensable products were collected. The gaseous products flowed through a quartz wool plug into a 4-liter bulb filled with water (at room temperature) which was at least partially replaced by product gases during a test run. Gaseous products were analyzed by means of a gas chromatograph. Liquid products were analyzed for gasoline and cycle oil yields by simulated distillation technique using a gas chromatograph. The amount of coke deposited on the cracking catalyst was determined by weighing the catalyst after the completion of the test.

Recycle gases used as fluidizing gases (in lieu of nitrogen) for the cracking catalyst were gas mixtures prepared in the laboratory simulating the compositions of treated and untreated off-gases from a commercial oil refinery. Compositions of an olefin-containing recycle off-gas (used in control runs) and of an olefin-free recycle off-gas (used in invention runs) are shown in Table I.

TABLE I

| Component (Mole %) | Recycle Gas A (With Olefins) | Recycle Gas B (Olefin-free) |
|---|---|---|
| Nitrogen + CO | 4.70 | 5.2 |
| Carbon Dioxide | 1.55 | 1.8 |
| Hydrogen Sulfide | 0.25 | 0.3 |
| Hydrogen | 62.7 | 70.8 |
| Methane | 15.8 | 17.6 |
| Ethane | 7.43 | 4.3 |
| Ethylene | 3.87 | 0 |
| Propylene | 2.72 | 0 |

Two oil feeds were used: Oil feed G was on "Alaskan North Slope" gas oil having API$^{60}$ gravity of 20.8 and containing 1.14 weight-% sulfur and 0.32 weight-% nitrogen (essentially no Ni, V). Oil feed H was a hydrotreated atmospheric resid having API$^{60}$ gravity of 18.5 and containing 0.41 weight-% sulfur, 0.16 weight-% nitrogen, 6.7 ppmw (parts per million by weight) nickel and 6.4 ppmw vanadium.

Two commercial cracking catalysts were employed: Catalyst L was a rare earth-exchanged zeolite-based equilibrium catalyst (i.e., having been used in a FCC cracking reactor and then regenerated) having a surface area of 112 $m^2/g$, a pore volume of 0.36 cc/g, vanadium content of 0.02 weight-%, nickel content of 0.01 weight-% and iron content of 0.54 weight-%. Catalyst M was also a rare earth-exchanged zeolite-based equilibrium cracking catalyst having a surface area of 99.1 $m^2/g$, a pore volume of 0.34 cc/g, vandium content of 0.25 weight-%, nickel content of 0.19 weight-%, iron content of 0.56 weight-% and antimony content of 0.11 weight-%. Both catalysts were provided by Davison Catalyst Division of W. R. Grace and Company and had been used in FCC cracking reactors in one of the commercial refineries of Phillips Petroleum, Bartlesville, Okla.

EXAMPLE II

Results of cracking rests using the oil feeds, catalysts and recycle gases discribed in Example I are summarized in Tables II, III and IV.

TABLE II

| Run | 1 (Base) | 2 (Control) |
|---|---|---|
| Catalyst | M | M |
| Oil Feed | H | H |
| Fluidizing Gas | $N_2$ | Recycle Gas A |
| Temperature (°F.) | 950 | 950 |
| Catalyst/Oil Wt. Ratio | 7:1 | 7:1 |
| Conversion of Feed (Vol %) | 87.7 | 86.8 |
| Composition of Liquid Product: | | |
| Gasoline[1](Vol %) | 64.3 | 65.5 |
| Light Cycle Oil[2](Vol %) | 8.5 | 9.1 |
| Heavy Cycle Oil[3](Vol %) | 3.8 | 4.1 |
| Other Products: | | |
| $C_1$–$C_4$ Gases (wt %) | 18.4 | 18.5 |
| Coke (wt %) | 15.8 | 16.2 |

[1]boiling range: 90–430° F. (at about 0 psig)
[2]boiling range: 430–650° F. (at about 0 psig)
[3]boiling range: 650° F.+ (at about 0 psig)

The selectivity to gasoline (gasoline yield/conversion×100) was 73.3% for run 1 and 75.5% for run 2. Thus a slight advantage of about 2% in terms of selectivity to gasoline was realized by using an olefin-containing recycle gas as fluidizing gas. Undesirable coke deposit was slightly higher in run 2.

TABLE III

| Run | 3 (Base) | 4 (Invention) |
|---|---|---|
| Catalyst | L | L |
| Oil Feed | G | G |
| Fluidizing Gas | $N_2$ | Recycle Gas B |
| Temperature (°F.) | 950 | 950 |
| Catalyst/Oil Wt. Ratio | 7:1 | 7:1 |
| Conversion of Feed (Vol. %) | 80.0 | 79.0 |
| Composition of Liquid Product: | | |
| Gasoline (vol. %) | 67.7 | 68.8 |
| Light Cycle Oil (Vol. %) | 12.9 | 13.5 |
| Heavy Cycle Oil (Vol. %) | 7.1 | 7.6 |
| Other Products: | | |
| $C_1$–$C_4$ Gases (Wt %) | 15.1 | 15.0 |
| Coke (Wt. %) | 8.7 | 7.5 |

The selectivity to gasoline was 84.6% for base run 3 and 87.1% for invention run 4. Thus an increase in selectivity to gasoline of 2.5% over the base run was realized by using olefin-free recycle gas B. This increase in selectivity to gasoline was about the same as that of control run 2 (with olefins in recycle gas) over the base run 1 (see previous paragraph). However, quite surprisingly, the coke formation in invention run 4 was lower than in base run 3, as compared to higher coke formation of control 2 versus base run 1 (see Table II). The lower coke formation in run 4 is considered a significant process improvement over control run 2.

TABLE IV

| Run | 5 (Base) | 6 (Invention) |
|---|---|---|
| Catalyst | M | M |
| Oil Feed | H | H |
| Fluidizing Gas | $N_2$ | Recycle Gas B |
| Temperature (°F.) | 950 | 950 |
| Catalyst/Oil Wt. Ratio | 7:1 | 7:1 |
| Conversion of Feed (Vol. %) | 84.9 | 83.9 |
| Composition of Liquid Product: | | |
| Gasoline (Vol. %) | 65.7 | 67.0 |
| Light Cycle Oil | 10.2 | 10.8 |
| Heavy Cycle Oil (Vol. %) | 4.9 | 5.3 |
| Other Products: | | |
| $C_1$–$C_4$ Gases (Wt. %) | 15.5 | 14.1 |
| Coke (Wt. %) | 13.9 | 13.3 |

Data in Table IV confirms those of Table III. Selectivity to gasoline was 79.9% in invention run 6 using olefin-free recycle gas versus 77.4% in base run 5, which represents an increase of 2.5%. Again, coke formation was lower in invention run 6 (with olefin-free recycle gas) than in base run 5, whereas coke formation was higher in control run 2 employing olefin-containing recycle gas than in the corresponding base run 1 (see Table I).

Reasonable variations and modifications are possible within the scope of the disclosure and the appended claims.

I claim:

1. A catalytic cracking process comprising the steps of:

(A) contacting (a) an oil feed stream comprising hydrocarbons having more than ten carbon atoms per molecule with (b) a solid cracking catalyst, under such conditions as to obtain (c) gaseous products comprising hydrogen, paraffins having from 1–4 carbon atoms per molecule and olefins having from 2–4 carbon atoms per molecule and (d) at least one stream of substantially liquid products comprising hydrocarbons having an average molecular weight lower than that of the hydrocarbons in said feed stream;

(B) substantially separating said gaseous products from said at least one stream of substantially liquid products and said solid cracking catalyst;

(C) treating at least a portion of the separated gaseous product from step B under such conditions as to reduce therein the content of olefins having 2–4 carbon atoms per molecule;

(D) recycling and introducing at least a portion of said gaseous product stream having reduced olefin content into the contacting zone of step A where said feed stream is contacted with said solid cracking catalyst, the recycle gaseous product stream comprising hydrogen and said paraffins;

(E) repeating steps A through D.

2. A process in accordance with claim 1 wherein said oil feed stream in step A has an $API^{60}$ gravity in the range of about 5 to about 30.

3. A process in accordance with claim 1 wherein said oil feed stream in step A has an $API^{60}$ gravity in the range of from about 10 to about 30 and a boiling range, at atmospheric pressure conditions, of above about 600° F.

4. A process in accordance with claim 1 wherein said solid cracking catalyst is a zeolite-containing catalyst.

5. A process in accordance with claim 4 wherein said solid cracking catalyst has a surface area of about 50–200 $m^2/g$ and a pore volume of about 0.2–1.0 cc/g.

6. A process in accordance with claim 4 wherein the weight ratio of said solid cracking catalyst to said feed stream is in the range of from about 2:1 to about 10:1 and the contact time between said feed stream and said solid cracking catalyst is in the range of from about 0.2 to about 2.0 seconds.

7. A process in accordance with claim 1 wherein said separated gaseous products are contacted in step C with an absorbent which contains a dissolved copper(I) compound, so as to reduce the content of said olefins in said gaseous products.

8. A process in accordance with claim 7 wherein said contacting with said absorbent is carried out at a temperature in the range of from about 0° C. to about 25° C. and at a pressure in the range of from about 2 atm to about 15 atm.

9. A process in accordance with claim 8 comprising the additional subsequent step of recovering absorbed olefins by heating said absorbent containing said olefins at a temperature of about 30°–50° C. under a pressure of about 1–2 atm.

10. A process in accordance with claim 1 wherein the weight ratio of the recycled portion of said gaseous products having reduced olefin content to said hydrocarbon feed stream is in the range of from about 0.05:1 to 1:1.

11. A process in accordance with claim 10 wherein said weight ratio of the recycled portion of said gaseous products having reduced olefin content to said hydrocarbon feed oil stream is in the range of about 0.3:1 to about 0.7:1.

12. A process in accordance with claim 1 further comprising the step of regenerating said solid cracking catalyst that has been separated from gaseous and liquid products in step B.

13. A process in accordance with claim 12 wherein said regenerating of said catalyst comprises steam stripping and subsequent heating in a free oxygen containing gas.

14. A process in accordance with claim 12 wherein said solid cracking catalyst is an FCC cracking catalyst.

15. A process in accordance with claim 12 comprising the additional step of combining the regenerated solid cracking catalyst with the recycled portion of said gaseous products having reduced olefin content from step C and then recycling the combined stream of said regenerated catalyst and said recycled portion of said gaseous products to the cracking zone in accordance with step D.

16. A process in accordance with claim 15 wherein said regenerated solid catalyst is a regenerated FCC catalyst.

17. A process in accordance with claim 16 wherein said regenerated solid FCC catalyst is admixed with fresh FCC catalyst.

18. A process in accordance with claim 1 wherein substantially all olefins having 2–4 carbon atoms are removed from said portion of the separated gaseous products in Step C, and said gaseous products recycled in step D are substantially olefin-free.

19. A process in accordance with claim 15, wherein the weight ratio of said recycled portion of said gaseous products having reduced olefin content to said regenerated solid cracking catalyst in said combined stream is in the range of from about 0.01:1 to about 0.5:1.

20. A process in accordance with claim 15, wherein the weight ratio of said recycled portion of said gaseous products having reduced olefin content to said regenerated solid cracking catalyst in said combined stream is in the range of from about 0.05:1 to about 0.2:1.

* * * * *